US006102651A

United States Patent [19]

Hahne et al.

[11] Patent Number: 6,102,651

[45] **Date of Patent: *Aug. 15, 2000**

[54] STACKING DEVICE FOR A CONVEYOR TRAY

[75] Inventors: Ernst A. Hahne, Allschwil, Switzerland; Hermann Kuenzig, Weil am Rhein, Germany; Iwan Christ, Brittnau, Switzerland

[73] Assignees: Grapha Holding AG, Hergiswil, Switzerland; Eltex-Elektrostatik GmbH, Weil am Rhein, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,666

[22] PCT Filed: Apr. 16, 1996

[86] PCT No.: PCT/CH96/00138

§ 371 Date: Dec. 16, 1996

§ 102(e) Date: Dec. 16, 1996

[87] PCT Pub. No.: WO96/33118

PCT Pub. Date: Oct. 24, 1996

[30] Foreign Application Priority Data

Apr. 19, 1995 [DE] Germany ..... 195 14 405
Apr. 26, 1995 [DE] Germany ..... 195 15 411

[51] Int. Cl.[7] ..... B65H 31/34

[52] U.S. Cl. ..... 414/788.9; 414/788; 414/907

[58] Field of Search ..... 271/208; 414/788, 414/788.9, 797.1, 907, 923

[56] References Cited

U.S. PATENT DOCUMENTS

| | | | |
|---|---|---|---|
| 2,640,605 | 6/1953 | Chatterton | 414/788.9 |
| 4,657,465 | 4/1987 | Aoki | 414/907 X |
| 5,228,373 | 7/1993 | Welsch | 414/788 X |
| 5,868,546 | 2/1999 | Hahne et al. | 414/788 |

FOREIGN PATENT DOCUMENTS 4034339 7/1991 Germany .

*Primary Examiner*—Janice L. Krizek
*Attorney, Agent, or Firm*—Venable; Robert Kinberg; Catherine M. Voorhees

[57] ABSTRACT

The invention relates to a device for forming stacks of items, e.g. stacked newspapers, periodicals or the like, on a tray for further conveyance in the direction of transport, where the stack is taken further by a cross assembler to a compacting tunnel, where there is a blocking device for the stack with at least one charging device with charging electrodes in the direction of transport on both sides near the stack, in which the charging device for electrostatically charging the objects is fitted in the cross assembler.

9 Claims, 1 Drawing Sheet

STACKING DEVICE FOR A CONVEYOR TRAY

BACKGROUND OF THE INVENTION

The invention relates to a stacking device for a conveyor tray.

Such a device is known per se and is used, for example, for the stacking of newspapers, magazines or the like in a so-called cross-assembler.

Such stacks of magazine copies when leaving the cross-assembler and during the transport to the compacting station have a tendency to slip or even topple, which is encouraged when the wire-stitching is applied to the magazines and by an uneven feeding. Stacking robots cannot be used here following the cross-assembler if a stack has slipped, which cannot be taken up.

SUMMARY OF THE INVENTION

For a device of the generic type, it is the object of the invention to have a more stable alignment for the piled-up stacks of items.

The above and other objects of the invention are accomplished in the context of a device for forming a stack of items to be transported on a tray in a conveying direction, for example, stacked newspapers, magazines or the like, wherein the stack is transported by a cross assembler to a compacting tunnel and wherein a blocking device for the stack is provided, and the blocking device has at least one charging device with charging electrodes arranged on both sides of the stack, wherein according to the invention, the charging device comprises means for elctrosdtatic charging of the items in the cross assembler.

In accordance with the teachings for the invention, the stack or partial stack is loaded during the stack formation in the cross-assembler. This has the advantage that the blocking is independent of the stack height. The stack blocking achieved in this way is particularly stable because the stack is also mechanically compacted during the blocking, meaning the mechanical force of pressure and the electrostatic forces complement each other.

DETAILED DESCRIPTION OF THE PREFERRED EMBODIMENT

Figure 1:
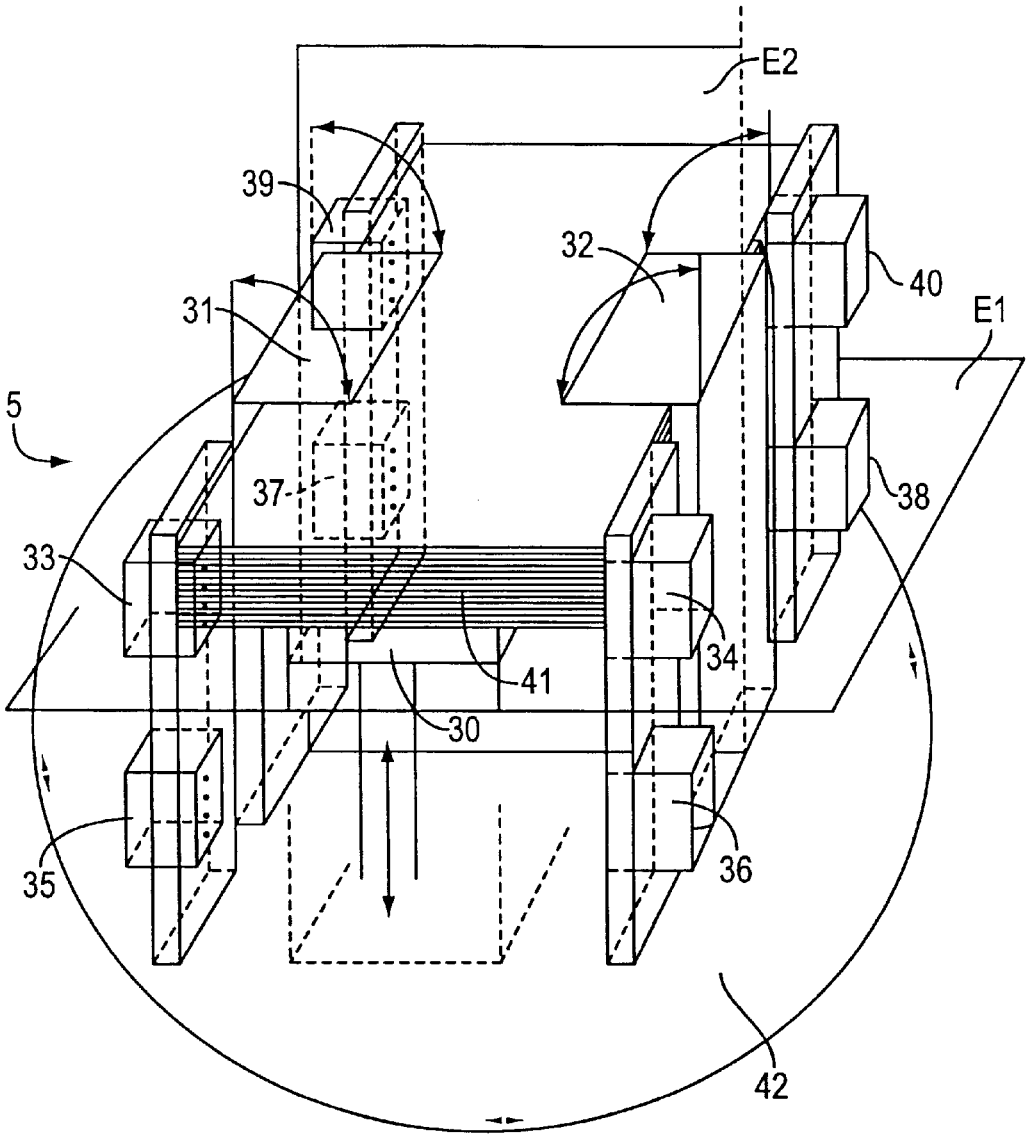
FIG. 1 is a perspective view of the present invention.

For the embodiment according to the invention, a charging device is arranged in the cross-assembler 5. This cross-assembler has a tray designed as a lifting platform 30 for a (partial) stack 41 as well as flaps 31, 32, which can be folded from the displayed horizontal operating position to a vertical operating position. After a counted partial stack (with opened flaps 31, 32) has fallen into the stack guidance of the cross-assembler, the flaps are closed and the lifting platform 30 is raised, causing the partial stack 41 to be compacted. Pairs of electrodes 33, 34 or 35, 36 or 37, 38 or 39, 40 are provided in the side walls of the stack guidance and are shown diagrammatically. These are arranged at a distance to each other, such that the stack/partial stack 41 is located between them. These electrodes can be connected during the compacting—depending on the height of the stack 41—by means of which a charge flows into the partial stack 41 and the individual sides and the items themselves are charged. The pairs of electrodes are arranged in a mirror symmetry to a first (horizontal in the drawing) plane E1 as well as to a second (in the drawing vertical) plane E2.

The flaps 31, 32 as well as the lifting platform 30 on the one hand and the electrodes of the charging device on the other have either opposite polarity, or the flaps and the lifting platform can be connected to a ground. Following the compacting and loading operation, the lifting platform 30 with the blocked partial stack 41 moves downward. Flaps 31, 32 are subsequently folded up. The rotary table 42 rotates by 180°. The previously counted (not shown) partial stack stored there above the cross assembler 5 drops onto the already loaded, blocked partial stack 41. The flaps 31, 32 close and the lifting platform 30 moves upward, so that a renewed compacting and blocking operation takes place with the cross assembled stack 41. Depending on the required, assembled number of copies of items or the height of the stack, the operation is repeated several times, until subsequently the stack is ejected. With a correspondingly high stack, an additional charge flows into the compacted stack from the pairs of charging electrodes of the charging device (35, 36; 37, 38), which are respectively arranged on the bottom.

What is claimed is:

1. In a device for forming a stack of paper items to be transported on a tray in a conveying direction, wherein the stack is transported by a cross assembler to a compacting tunnel and wherein a blocking device for the stack is provided, the blocking device defining a space for receiving the stack, the space having a top, and a bottom opposite to the top, and at least two pairs of opposed sides, and the blocking device further includes at least one charging device, the improvement wherein the charging device includes at least first and second charging electrodes, the first electrode located on a first side of the defined space and the second electrode located on a second side and opposite to the first electrode, the charging device comprises means for electrostatic charging of the paper items in the stack formed in the cross assembler, and wherein the tray comprises a lifting platform for the cross assembler.

2. Device according to claim 1, wherein the cross assembler includes flaps, the first and second charging electrodes have a first polarity, and the lifting platform and the flaps are either grounded or electrically chargeable with a second polarity that is opposite to said first polarity.

3. Device according to claim 2, wherein the at least first and second charging electrodes is a first pair of charging electrodes and the charging device further includes:

- a second pair of charging electrodes, located opposite to each other and above the first pair;
- a third pair of charging electrodes, located opposite to each other and side-by-side with the first pair;
- a fourth pair of charging electrodes, located opposite to each other and side-by-side with the second pair and above the third pair.

4. Device according to claim 3, wherein the four pairs of charging electrodes are arranged in a mirror symmetry to a horizontal plane arranged between the first pair and the second pair and between the third pair and the fourth pair.

5. Device according to claim 3, wherein the four pairs of charging electrodes are arranged in a mirror symmetry to a vertical plane arranged between the first pair and the third pair and between the second pair and the fourth pair.

6. In a device for forming a stack of paper items to be transported in a conveying direction, wherein the stack is transported by a cross assembler to a compacting tunnel and wherein a blocking device for the stack is provided, the blocking device defining a space for receiving the stack, the space having a top, and a bottom opposite to the top, and at least two pairs of opposed sides, and the blocking device further includes:

at least one flap, movably mounted approximately at the top of the defined space, for opening or closing the top of the defined space, and the flaps are either electrically grounded or electrically chargeable with a first polarity;

a lifting platform, vertically movable within the defined space, and the lifting platform is either electrically grounded or electrically chargeable with the first polarity;

at least one charging device, the charging device including at least a first and a second charging electrodes, the first electrode located on a first side of the defined space and the second electrode located on a second side and opposite to the first electrode, and the first and second charging electrodes having a second polarity that is opposite to said first polarity.

7. Device according to claim 6, wherein the first and second charging electrodes are a first pair of charging electrodes and the charging device further includes:

a second pair of charging electrodes, located opposite to each other and above the first pair;

a third pair of charging electrodes, located opposite to each other and side-by-side with the first pair;

a fourth pair of charging electrodes, located opposite to each other and side-by-side with the second pair and above the third pair.

8. Device according to claim 7, wherein the four pairs of charging electrodes are arranged in a mirror symmetry to a horizontal plane arranged between the first pair and the second pair and between the third pair and the fourth pair.

9. Device according to claim 7, wherein the four pairs of charging electrodes are arranged in a mirror symmetry to a vertical plane arranged between the first pair and the third pair and between the second pair and the fourth pair.

* * * * *